US010384412B2

(12) United States Patent
Martin et al.

(10) Patent No.: US 10,384,412 B2
(45) Date of Patent: Aug. 20, 2019

(54) DRIVE APPARATUS AND METHOD FOR A PRESS MACHINE

(71) Applicant: Nidec Vamco Corporation, Pittsburgh, PA (US)

(72) Inventors: Vaughn H. Martin, Mars, PA (US); Bryan P. Gentile, Longboat Key, FL (US)

(73) Assignee: Nidec Vamco Corporation, Pittsburgh, PA (US)

( * ) Notice: Subject to any disclaimer, the term of this patent is extended or adjusted under 35 U.S.C. 154(b) by 1216 days.

(21) Appl. No.: 14/277,398

(22) Filed: May 14, 2014

(65) Prior Publication Data

US 2014/0245907 A1 Sep. 4, 2014

Related U.S. Application Data

(63) Continuation of application No. 12/741,867, filed as application No. PCT/US2008/082831 on Nov. 7, 2008.

(60) Provisional application No. 60/986,942, filed on Nov. 9, 2007.

(51) Int. Cl.

| | |
|---|---|
| ***B30B 15/16*** | (2006.01) |
| ***B30B 1/32*** | (2006.01) |
| ***B30B 15/14*** | (2006.01) |
| ***B30B 1/34*** | (2006.01) |
| ***B30B 1/42*** | (2006.01) |

(52) U.S. Cl.

CPC ..... *B30B 15/168* (2013.01); *B30B 1/32* (2013.01); *B30B 1/34* (2013.01); *B30B 1/42* (2013.01); *B30B 15/14* (2013.01); *B30B 15/16* (2013.01)

(58) Field of Classification Search

CPC .... B30B 1/32; B30B 1/34; B30B 1/42; B30B 15/14; B30B 15/16; B30B 15/168

See application file for complete search history.

(56) References Cited

U.S. PATENT DOCUMENTS

| | | | | |
|---|---|---|---|---|
| 2,047,615 A | | 7/1936 | Chadborn | |
| 2,214,817 A | * | 9/1940 | Harrington | B30B 15/16 137/115.19 |
| 2,349,641 A | | 5/1944 | Tucker et al. | |

(Continued)

FOREIGN PATENT DOCUMENTS

| | | |
|---|---|---|
| DE | 270883 | 8/1989 |
| EP | 1120236 | 1/2001 |

(Continued)

OTHER PUBLICATIONS

Office Action dated Mar. 30, 2015 for Japanese Divisional Patent Application 2013-168715 (corresponding to U.S. Appl. No. 14/277,398).

(Continued)

*Primary Examiner* — Jimmy T Nguyen

(74) *Attorney, Agent, or Firm* — Reed Smith LLP

(57) ABSTRACT

A drive apparatus includes a movable member, at least one linear electrical actuator for generating a first force, and at least one linear hydraulic actuator for generating a second force. The at least one linear electrical actuator and the at least one linear hydraulic actuator are arranged such that the first force and the second force act in parallel on the movable member in order to result in a combined force.

7 Claims, 9 Drawing Sheets

(56) References Cited

U.S. PATENT DOCUMENTS

| | | | | |
|---|---|---|---|---|
| 2,547,929 | A | | 4/1951 | Dawson |
| 3,015,344 | A | | 1/1962 | Werner et al. |
| 3,022,772 | A | | 2/1962 | Zeigler et al. |
| 3,199,539 | A | | 8/1965 | Leathem |
| 3,424,059 | A | | 1/1969 | Conner |
| 3,442,291 | A | | 5/1969 | Carls |
| 3,552,182 | A | * | 1/1971 | Handler ..... B21D 5/02 72/432 |
| 3,848,515 | A | | 11/1974 | Gardineer et al. |
| 4,011,809 | A | | 3/1977 | Waller et al. |
| 4,106,390 | A | | 8/1978 | Kodaira et al. |
| 4,148,203 | A | | 4/1979 | Farazandeh et al. |
| 4,170,124 | A | | 10/1979 | MacGregor |
| 4,569,371 | A | | 2/1986 | Dolejs |
| 4,593,719 | A | | 6/1986 | Leonard |
| 4,646,599 | A | | 3/1987 | Benedict |
| 4,779,512 | A | | 10/1988 | Leonard |
| 4,800,924 | A | | 1/1989 | Johnson |
| 4,831,862 | A | | 5/1989 | Ohashi et al. |
| 4,836,249 | A | | 6/1989 | Lapointe |
| 4,977,816 | A | | 12/1990 | Kuttruf |
| 5,235,911 | A | | 8/1993 | Dorfman et al. |
| 5,243,896 | A | | 9/1993 | Rodriguez |
| 5,252,902 | A | | 10/1993 | Uehara et al. |
| 5,407,402 | A | | 4/1995 | Brown et al. |
| 5,460,084 | A | | 10/1995 | Otremba |
| 5,467,800 | A | | 11/1995 | Sallas |
| 5,544,577 | A | | 8/1996 | Kato |
| 5,568,766 | A | | 10/1996 | Otremba et al. |
| 5,729,067 | A | | 3/1998 | Janutka |
| 5,954,093 | A | | 9/1999 | Leonard |
| 5,960,626 | A | | 10/1999 | Baudu |
| 6,041,699 | A | | 3/2000 | Seto et al. |
| 6,070,521 | A | | 6/2000 | Otoshi |
| 6,169,934 | B1 | | 1/2001 | Nakayama et al. |
| 6,205,916 | B1 | | 3/2001 | Castleton |
| 6,206,683 | B1 | | 3/2001 | Takahashi et al. |
| 6,237,479 | B1 | | 5/2001 | Douba |
| 6,316,903 | B1 | | 11/2001 | Shamoto |
| 6,337,042 | B1 | | 1/2002 | Nakashima et al. |
| 6,366,046 | B1 | | 4/2002 | Yan et al. |
| 6,384,561 | B1 | | 5/2002 | Niizuma et al. |
| 6,453,718 | B1 | | 9/2002 | Schmeink et al. |
| 6,470,913 | B1 | | 10/2002 | Woodworth |
| 6,594,992 | B1 | | 7/2003 | Naito et al. |
| 6,619,088 | B1 | | 9/2003 | Oyamada et al. |
| 6,647,870 | B2 | | 11/2003 | Kohno |
| 6,751,997 | B1 | | 6/2004 | Gustafsson et al. |
| 6,813,885 | B2 | | 11/2004 | Malmquist et al. |
| 6,826,998 | B2 | | 12/2004 | Pinot |
| 6,926,648 | B2 | | 8/2005 | Capizzo |
| 6,970,767 | B2 | | 11/2005 | Teraoka |
| 6,990,896 | B2 | | 1/2006 | White et al. |
| 7,013,917 | B2 | | 3/2006 | Joseph |
| 7,049,775 | B2 | | 5/2006 | Iwashita et al. |
| 7,097,399 | B2 | | 8/2006 | Winfough et al. |
| 7,102,316 | B2 | | 9/2006 | Beyer et al. |
| 7,106,023 | B2 | | 9/2006 | Ota et al. |
| 2002/0078730 | A1 | | 6/2002 | Hatty |
| 2004/0170718 | A1 | | 9/2004 | Futamura et al. |
| 2006/0096644 | A1 | | 5/2006 | Goldfarb |
| 2006/0097939 | A1 | | 5/2006 | Eigenmann |
| 2006/0156933 | A1 | | 7/2006 | Hofele et al. |
| 2007/0062247 | A1 | | 3/2007 | Hofele et al. |
| 2007/0069592 | A1 | | 3/2007 | Spickard |
| 2007/0074509 | A1 | | 4/2007 | Zhang et al. |
| 2007/0101711 | A1 | | 5/2007 | Debus |
| 2008/0134909 | A1 | | 6/2008 | Kohno et al. |
| 2008/0202115 | A1 | | 8/2008 | Geiger |
| 2010/0307349 | A1 | | 12/2010 | Martin et al. |

FOREIGN PATENT DOCUMENTS

| | | |
|---|---|---|
| EP | 1213132 | 6/2002 |
| EP | 1275492 | 1/2003 |
| EP | 1837169 | 9/2007 |
| JP | 56059001 | 5/1981 |
| JP | 6133795 | 2/1986 |
| JP | H0737484 | 7/1995 |
| JP | 09225700 | 9/1997 |
| JP | HEI 9-225700 | 9/1997 |
| JP | 11254198 | 9/1999 |
| JP | 2000297866 | 10/2000 |
| JP | 2001-225194 | 8/2001 |
| JP | 2001225194 | 8/2001 |
| JP | 2003230999 | 8/2003 |
| JP | 2003290984 | 10/2003 |
| JP | 2004063930 | 2/2004 |
| JP | 2005202201 | 7/2005 |
| JP | 2005-254252 | 9/2005 |
| JP | 2006154422 | 6/2006 |
| JP | 2006192458 | 7/2006 |
| JP | 2007063930 | 3/2007 |
| JP | 2007-116898 | 11/2008 |

OTHER PUBLICATIONS

Office Action dated Aug. 14, 2015 for European Patent Application 08 847 724.5 (corresponding to U.S. Appl. No. 14/227,398).

Office Action dated Mar. 18, 2015 for Korean Divisional Patent Application 10-2015-7000898 (corresponding to U.S. Appl. No. 14/277,398).

International Search Report corresponding to International Application No. PCT/US2008/82831 dated Mar. 23, 2009.

International Preliminary Report on Patentability corresponding to International Application No. PCT/US2008/82831 dated Oct. 26, 2010.

Office Action dated Jul. 16, 2012 for Chinese Application 200880124185.X (corresponding to U.S. Appl. No. 12/741,867).

Supplementary European Search Report corresponding to European Application No. EP08847724 dated Feb. 22, 2012.

Office Action issued by the Japanese Patent Office dated Feb. 14, 2013 for Japanese Application No. 2010-533281.

Office Action issued by the European Patent Office dated May 19, 2014 corresponding to International Application No. PCT/US2008/82831 dated Mar. 29, 2009.

Office Action issued by the Japanese Patent Office dated Nov. 2, 2013 for Japanese Application No. 2010-533281.

Office Action issued by the Japanese Patent Office dated Aug. 14, 2014 for Japanese Application No. 2013-168715.

Office Action issued by the Korean Patent Office dated Jul. 24, 2014 for Korean Application No. 1020107012718.

* cited by examiner

DRIVE APPARATUS AND METHOD FOR A PRESS MACHINE

CROSS-REFERENCE TO RELATED APPLICATION

This application is a continuation and claims the benefit under 35 U.S.C. § 120 of U.S. application Ser. No. 12/741,867, filed May 7, 2010, which is a 371 National Stage of International Application No. PCT/US2008/082831, filed Nov. 7, 2008, which claims the benefit of 35 U.S.C. § 119(e) of the earlier filing date of U.S. Provisional Application Ser. No. 60/986,942 filed on Nov. 9, 2007, the contents of which are hereby incorporated by reference.

FIELD OF THE INVENTION

This description relates to a drive apparatus for a movable member such as a ram that can be used, for example, in a press machine.

BACKGROUND OF THE INVENTION

A press machine is a tool used to work a material such as metal by changing its shape and internal structure to form pieces.

A punch press is a type of press machine used for forming and/or cutting material. The punch press holds one or more die sets that can be small or large, depending on the shape of the pieces to be manufactured. The die set consists of a set of (male) punches and (female) dies that, when pressed together, can form a hole in a workpiece or can deform the workpiece in some desired manner. The punches and the dies can be removable with the punch being temporarily attached to the end of a ram during the punching process. The ram moves up and down in a vertically linear motion.

In other designs, the press machine can include a set of plates having a relief, or a depth-based design, in them such that when the metal is placed between the plates, and the plates are pressed up against each other, the metal is deformed in the desired fashion. Such a machine press can be used for coining, embossing, or forming.

Additionally, if the press machine is automatic, then it can be fed with the material (such as coiled stock material) using a press feed.

SUMMARY OF THE INVENTION

The general concept of the present invention refers to a drive apparatus, in particular for a press, having a movable member and at least one actuator. This general concept can be combined with anyone or more of the following optional aspects. The present invention also refers to a press machine having a drive apparatus with anyone or more of the following optional aspects.

According to a first aspect, the drive apparatus includes a movable member, at least one linear electrical actuator for generating a first force, and at least one linear hydraulic actuator for generating a second force. A linear electrical actuator is an actuator which produces a linear movement and whose primary motivating power is supplied by electricity. In a most preferred embodiment the linear electrical actuator is a direct drive linear motor. In a less preferred embodiment, the linear electrical actuator is a rotary electric motor and a mechanism for converting rotary motion to linear motion. Such mechanisms can include, but are not limited to, lead screw and nut arrangements, rack and pinion gear arrangements, and timing belt and pulley arrangements. A linear hydraulic actuator is an actuator which produces a linear movement and whose primary motivating power is supplied by hydraulic fluid. In a most preferred embodiment the linear hydraulic actuator is a hydraulic cylinder. In a less preferred embodiment, the linear hydraulic actuator is a rotary hydraulic motor and a mechanism for converting rotary motion to linear motion. Such mechanisms can include, but are not limited to, lead screw and nut arrangements, rack and pinion gear arrangements, and timing belt and pulley arrangements. The at least one linear electrical actuator and the at least one linear hydraulic actuator are arranged such that the first force and the second force act in parallel on the movable member in order to result in a combined force, wherein the movable member is movable in a first direction and a second direction opposite to the first direction. The at least one linear electrical actuator, or more precisely, the movable part of the electrical actuator, is preferably coupled to the movable member such that the at least one linear electrical actuator and the movable member can be moved synchronously. The at least one linear hydraulic actuator is preferably coupled to the movable member such that the at least one linear hydraulic actuator and the movable member can be moved synchronously.

While the above description describes the at least one linear hydraulic actuator as preferably coupled to the movable member, it should be noted that the at least one hydraulic actuator need not be independently coupled to the moving member but instead could be coupled to the moving portion of the at least one linear electrical actuator and thereby coupled to the moving member. Furthermore the at least one linear electrical actuator could be coupled to the moving portion of the at least one hydraulic actuator and thereby coupled to the moving member. Any number of coupling arrangements are possible in so far as the resulting arrangement provides for a parallel force combination of the various actuators acting on the moving member.

The combination of at least one linear electrical actuator and at least one linear hydraulic actuator has several advantages. The drive apparatus has less internal friction, and because the actuators can be directly coupled to the movable member a power transmission and any associated inaccuracies or backlash can be reduced and/or avoided. Further, the impact and dynamic response can be increased, vibrations and noises are reduced, and the controllability of the movement of the movable member, in particular, the ram of a press, as well as forces applied to the movable member by the actuators dependent on the position of the movable member is significantly improved. As a result, the drive apparatus can be driven faster while having a highly controlled positioning and force application in accordance with predetermined curves. In particular, a high speed lifting and lowering actuation is possible, whereas the actual pressing movement is performed with a lower speed, but with increased forces.

For controlling the actuation of the at least one electrical actuator at least one first electrical control device can be provided. For controlling the actuation of the at least one hydraulic actuator, at least one hydraulic control member, for example, a valve, can be provided, and the at least one hydraulic control member is operated by a second electrical control device. A central control unit can be used for sending control signals to the first and second electrical control devices for controlling the actuation of the at least one linear electrical actuator and the actuation of the at least one linear hydraulic actuator.

Preferably, at least one position sensor for measuring the position of the movable member is provided, where the at least one position sensor is in communication with the central control unit for sending the position signals to the central control unit. With that, the central control unit can be configured to operate the drive apparatus such that the at least one linear hydraulic actuator is controlled in accordance with a cyclic operation of the at least one hydraulic control member, and such that the at least one linear electric actuator is controlled dependent on the position signals in order to ensure a controlled cyclic actuation of the movable member.

As a result, the advantage of a hydraulic actuator (namely, the ability to generate high forces) can be combined with the advantage of an electric actuator (namely, the improved dynamics and improved position control). If, for example, the forces generated by the hydraulic actuator should differ slightly from cycle to cycle, this difference can be compensated for by the at least one electric actuator. Accordingly, if the position of the movable member resulting from the hydraulic actuator should differ slightly from cycle to cycle, then this position difference can be adjusted by the at least one electric actuator. In fact, even the upper and lower dead centers of the cyclic movement of the movable member can be adjusted by controlling the at least one electric actuator, whereas the control of the hydraulic actuator is not changed.

As an example, if the upper and lower dead centers should be further lowered, the at least one electric actuator increases the force during the downward movement and/or maintains a downwardly directed force when during the upward movement of the movable member. This has the effect that the flow of the hydraulic fluid during the movement of the hydraulic actuator is changed, because the forces generated by the at least one electric actuator has an impact on the pressure conditions within the hydraulic actuator. After having changed the upper and lower dead centers, the at least one electric actuator can be driven like before the change.

According to a second aspect, the drive apparatus includes a movable member including a ram of a press, and at least three electrical actuators coupled to the movable member, where the at least three (and, in one preferred implementation, four) linear electrical actuators are independently operable. Each electrical actuator is coupled to the movable member at a different discrete coupling point or part of the movable member. At least three electrical control devices for controlling actuation of the at least three linear electrical actuators are provided.

With that, it is possible to provide an independent positional adjustment of the movable member at the coupling point of the respective electrical actuators, for example, to provide adjustment of one or more of a pitch, a roll, and a linear position of the movable member.

Preferably, at least three position sensors for measuring the positions of the movable member at the respective coupling points are provided, where the at least three position sensors are in communication with the central control unit for sending the position signals to the central control unit. Dependent on the position signals, the central control unit sends control signals to the electrical control devices for controlling the actuation of the at least three electrical actuators.

A further advantage of this aspect is that no or only a small passive guide for the movable member is necessary such that the movable member is not directly coupled to a passive guide. It is sufficient to only provide one or more passive guides directly coupled to an output of at least one of the three linear electrical actuators. As a result, internal friction is further reduced.

According to a third aspect, the drive apparatus includes a movable member, at least one actuator coupled to the movable member for moving the movable member in reversible directions, and at least one energy storage device coupled to the movable member, where the at least one energy storage device has a force path characteristic.

The force path characteristic of the at least one energy storage device is preferably such that the force exerted by the at least one energy storage device on the movable member changes its direction at a position of the movable member that is within the working range of the movable member or provides a positioning of the movable member within an operational range of the movable member.

When operating the drive apparatus in a cyclic manner, the energy consumption of the at least one actuator can be significantly reduced if the drive apparatus is driven at or close to the natural frequency ("Eigenfrequency") of the drive apparatus. As the moved masses are constant, and the operating frequency of the drive apparatus should be determined in a flexible manner by the user, wherein the force path characteristic of the at least one energy storage device is adjustable such that the natural frequency of the drive apparatus is at or close to the movement frequency of the movable member.

The energy storage device can include at least one gas spring. The gas spring may be a cylinder and piston type or a bladder type. In particular, at least one gas spring is positioned relative to the movable member and the at least one actuator to store energy that can be released along a first direction along the linear axis, and at least one gas spring is positioned relative to the movable member and the at least one actuator to store energy that can be released along a second direction along the linear axis, where the second direction is opposite to the first direction. The force path characteristic of the at least one gas spring is adjustable by adjusting the gas pressure, for example, by increasing the gas pressure utilizing a pressure gas source or by decreasing the gas pressure utilizing an outlet valve. In an embodiment where at least one linear actuator is a hydraulic actuator, the energy storage device is preferably fluidly decoupled from the hydraulic actuator.

Instead of or in addition to the gas spring(s), at least one elastic spring can be provided as the energy storage device, each elastic spring being coupled to the movable member at a first end. The at least one elastic spring is adjustable by adjusting the fixing position of a second end of the at least one elastic spring with respect to the first end such as to increase or decrease the spring constant of the at least one elastic spring. It should be understood that the adjusting of a fixing position of the second end of the at least one elastic spring may be an adjusting of a constraining element applied to an intermediate portion of the elastic spring thereby reducing the effective (working) length of the at least one elastic spring rather than an adjustment of the position of an end of the actual spring element. Alternatively, this adjustment of the position of the second end of the at least one elastic spring may be a rotational adjusting of the end position of the at least one elastic spring. In these and other cases, the adjusting of the fixing position of a second end of the at least one elastic spring will result in an increase or decrease of the spring constant of the at lease one elastic spring.

A control unit is preferably configured to adjust the force path characteristic of the at least one energy storage device such that the natural frequency of the drive apparatus is at or close to the movement frequency of the movable member. The control unit determines the required force path characteristic or the required spring constant of the at least one gas or elastic spring for operating at or close to the natural frequency of the drive apparatus: by calculating the necessary force path characteristic or the necessary spring constant on basis of the moving masses and the desired operating frequency; by using selected or predetermined values; or by adjusting the force path characteristic in dependence on the power consumption of the at least one linear electrical actuator and the at least one linear hydraulic actuator. The latter possibility is more elegant, because a reduction of the power consumption is the goal of providing the energy storage device and of the adjustment of its force path characteristic. In case of the first possibility, the relationship $\omega=\sqrt{(k/m)}$ can be used to calculate the required force path characteristic of the energy storage device where $\omega$ is the natural frequency, m is the sum of the moved masses and k is the proportional spring constant of the force path characteristic, of the drive apparatus or the energy storage device, respectively. Although the preferred force path characteristic is characterized by the proportional relationship $F=k*x$, where F is force, k is a constant and x is the displacement of the energy storage device, it should be understood that any device which has a force path characteristic capable of producing an oscillating movement of a mass could be used instead.

According to a fourth aspect, the drive apparatus includes a movable member, at least one actuator coupled to the movable member for moving the movable member in reversible first and second directions, and a passive force exerting device coupled to the movable member wherein the passive force exerting device primarily receives and stores energy while the movable member is moving in the second direction, and the passive exerting device is arranged to primarily exert the additional force on the movable member in the first direction. The passive force exerting device is arranged in parallel with the at least one actuator in order to exert an additional force on the movable member in the first direction without requiring an additional external energy supply. With that, the movement in the second direction, in particular, the lifting movement of the at least one actuator can be used in order to increase the compressive force in the first direction.

The passive force exerting device can include a cylinder housing a piston and a fluid, for example, a gas such as nitrogen gas. The passive force exerting device is fluidly decoupled from a hydraulic actuator, if present and from an energy storage device, if present. The force exerted of the passive force exerting device is preferably about constant over the operating range of the movable member. This can be achieved by a comparatively large volume, for example, by connecting the cylinder to an additional high pressure reservoir.

According to a fifth aspect, the drive apparatus includes a movable member including a ram of a press, at least one hydraulic actuator coupled to the movable member for moving the movable member, a hydraulic control member for controlling the actuation of the at least one hydraulic actuator, and a servo motor for controlling the actuation of the hydraulic control member. As the actuation of the servo motor can be controlled in a very exact and fast manner, the hydraulic control member, for example, a valve, can also be operated accordingly with the effect that a fast and precise actuation of the hydraulic actuator and thus of the press ram can be achieved.

The servo motor for the hydraulic control member is preferably controlled by an electrical control device so that the position of the hydraulic control member and thus the movement of the at least one hydraulic actuator is controlled accordingly. A central control unit can be used for sending control signals to the second electrical control device for controlling the actuation of the servo motor so that the position of the hydraulic control member and thus movement of the at least one hydraulic actuator is controlled.

The hydraulic control member preferably has at least one first position for moving the at least one hydraulic actuator in a first direction, at least one second position for moving the at least one hydraulic actuator in a second direction opposite to the first direction, and at least one third position in which the at least one hydraulic actuator is immovable. With that, it is possible that an actuation cycle of the drive apparatus includes the steps of: (a) driving the at least one hydraulic actuator in the first direction, (b) driving the at least one hydraulic actuator in the second direction, and (c) holding the movable member in a fixed position by positioning the hydraulic control member in a third position.

An advantage of this operation is that the movement of the movable member can be kept small while still allowing sufficient time for the removal of a processed workpiece and the insertion of an unprocessed workpiece (for example, by a press feeder). The blocked hydraulic control member blocks in its third position any movement of the hydraulic actuator and thus the movable member so that also the passive force exerting device, if present, can be held in a compressed state without the need of an additional input force. A further advantage of this operation is that, if provided, an at least one electric actuator is not operated, not provided with electric current, or is only insignificantly provided with electric current to allow the at least one electric actuator a time interval in which to cool.

The hydraulic control member can be a valve with a rotatable member, where the function of the valve depends on the angle position of the rotatable member, and where the rotatable member is driven by the servo motor. Such a valve can be operated by the central control unit with a constant frequency and/or a constant speed. The central control unit can also be configured such that the valve having a rotatable member can be operated at rotational speeds which are dependent on the angle positions of the rotatable member in order to control the timing of the positions of the hydraulic control member.

As initially mentioned, the any one or more of the above optional aspects can be used for a drive apparatus. Therefore, the drive apparatus can be designed as a modular system that can be adapted to the needs of a specific application where only one or two aspects are used, and where other aspects can be added at a later stage, if necessary.

The drive apparatus can be operated in various operation modes. In a first mode, only the at least one electric actuator can be used in combination with the at least one energy storage device (with preferably adjustable force path characteristic). In order to reduce power consumption, the electrical actuators can move the movable member, for example, in a sinusoidal manner (regarding path over time graph), where the force path characteristic of the energy storage devices is adjusted to this sinusoidal movement (such that the time period of the natural frequency corresponds to the time period of the sinusoidal movement of the electric actuators).

In a second mode, the at least one hydraulic actuator (and, if desired, the at least one electric actuator) can be used in combination with the passive force exerting device. This mode is advantageous in case of higher necessary punching or pressing forces. In this mode, power consumption is reduced by keeping the lifting actuation to a minimum so that the fluid supplied to the hydraulic actuator(s) can be reduced accordingly. As already mentioned, the lifting movement of the hydraulic actuator(s) can be used in order to compress the passive force exerting device for storing additional energy. This mode is preferred in case of high necessary forces and in case of non-sinusoidal movements of the movable member. In the latter case, the graph regarding path over time could, for example, be a horizontal line interrupted by short downwardly directed peaks. Or, according to another example, the graph regarding path over time could be a "partial" sinusoidal graph with only the downwardly directed sinus curves, where the upwardly directed sinus curves are substituted by horizontal lines. As an unnecessary high lifting movement is avoided, also the speed of the drive apparatus can be increased.

Also mixed (third) modes are possible in which the electric and hydraulic actuators are used in combination with the energy storage device(s) and the passive force exerting device(s), where the spring constant of the energy storage device(s) and the characteristic of the passive force exerting device(s) can be optimized in order to reduce power consumption (for example, by means of a least squares method).

As a result, the drive apparatus as described above can be used in various manners, depending on the needs of a particular application. The user can use the drive apparatus (for example, for a press) in the first mode if a high speed operation with low forces is required, or in the second mode, if higher forces with lower speeds are required.

The novel features which are considered characteristic of the present invention are set forth herebelow. The invention itself, however, both as to its construction and its method of operation will be best understood from the following description of the specific embodiments when read and understood in connection with the accompanying drawings.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification.

DETAILED DESCRIPTION OF THE PREFERRED EMBODIMENTS

Figure 1:
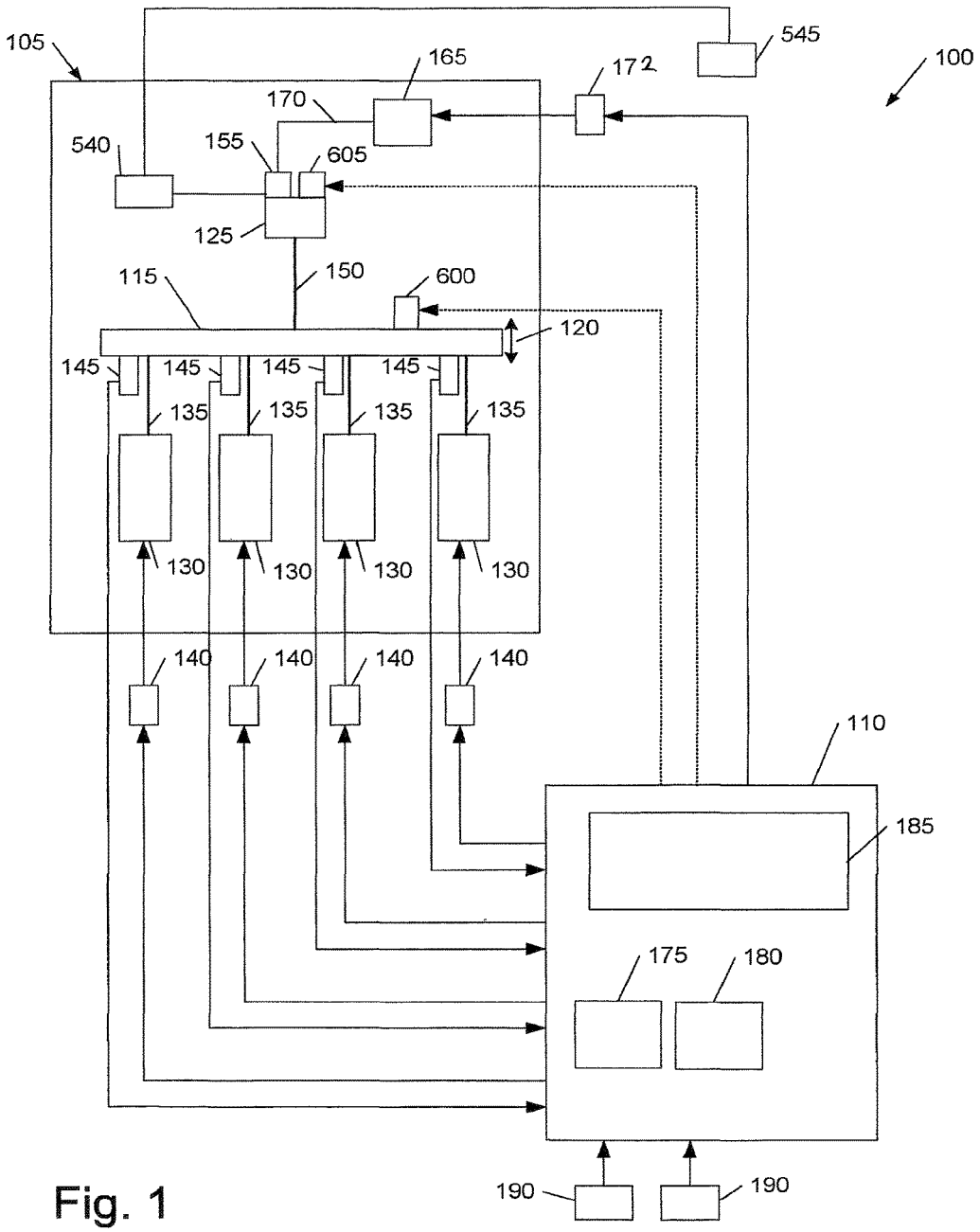
FIG. 1 shows a schematic view of a first implementation of a drive mechanism.
Figure 2:
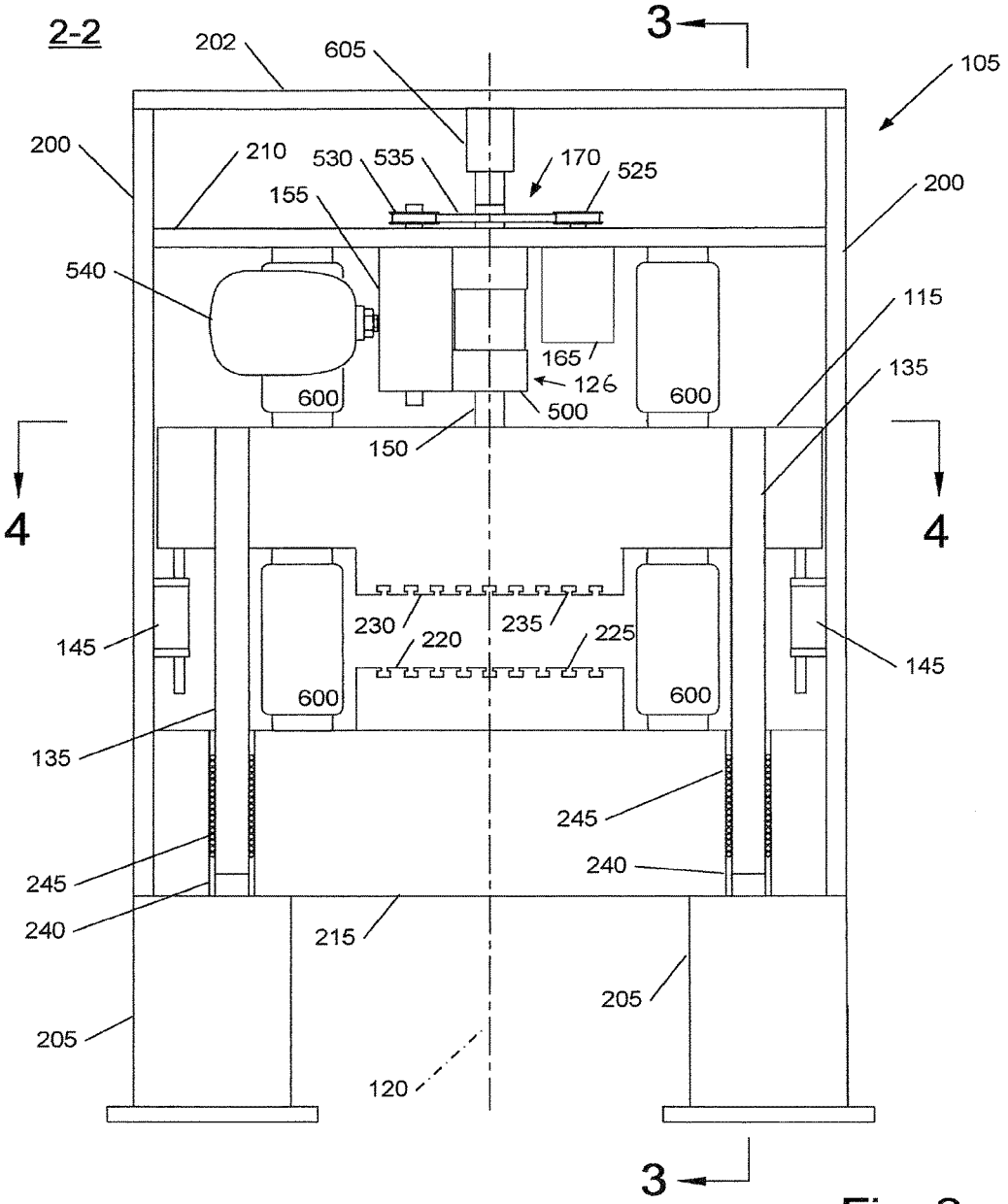
FIG. 2 shows a cross sectional view (along lines 2-2 in FIG. 4) of a drive mechanism according to the first implementation.

Referring to FIG. 1, a drive apparatus 100 for controlling, for example, a press machine 105 is shown. The drive apparatus 100 includes an electronic control system 110 coupled to the press machine 105. A general description of the parts of the machine press 105 that are coupled to the electronic control system 110 is provided in reference to FIG. 1 and details of the press machine 105 are discussed with additional reference to FIGS. 2-5.

As shown in FIG. 1, the press machine 105 includes a movable member 115, such as, for example, a ram for a press machine, that generally moves along a main axis 120. The movable member 115 is coupled at various coupling points or regions to one or more linear hydraulic actuators 125 and one or more linear electrical actuators 130 in a hybrid arrangement such that the one or more linear hydraulic actuators 125 and/or the one or more linear electrical actuators 130 can be moved synchronously with the movable member. The linear hydraulic actuators 125 and the linear electrical actuators 130 are arranged in parallel with respect to the movable member 115. The linear hydraulic actuators 125 generate a first force and the linear electrical actuators 130 generate a second force such that the first force and the second force act in parallel on the moveable member 115 in order to result in a combined force.

As stated above, the combination of the one or more linear electrical actuator 130 and the one or more linear hydraulic actuator 125 as shown in FIGS. 1-5 has several advantages. The drive apparatus 100 has less internal friction, because the actuators can be directly coupled to the movable member 115 so that a power transmission and an undesired play can be avoided. Further, the impact and dynamic response can be increased, vibrations and noises are reduced, and the controllability of the movement of the movable member 115 as well as forces applied to the movable member 115 by the actuators dependent on the position of the movable member 115 is significantly improved. As a result, the drive apparatus 100 can be driven faster while having a highly controlled positioning and force application in accordance with predetermined curves. In particular, a high speed lifting and lowering actuation is possible, whereas the actual pressing movement is performed with a lower speed, but with increased forces.

Each linear electrical actuator 130 is arranged in the direction of the main axis 120 and the output of the linear electrical actuator 130 is provided to a rigid post 135 that couples to (for example, attaches to) the movable member 115. The rigid post 135 is movable in both directions along the main axis 120. Each linear electrical actuator 130 is associated with an electrical control device 140, which is connected to the electronic control system 110 to receive a signal from the electronic control system 110. Additionally, the press machine 105 includes position detectors 145 associated with each linear electrical actuator 130 and being positioned to couple to a coupling region of the movable member 115. Each position detector 145 measures an absolute position of the movable member 115 at the coupling region.

The position detector 145 can be any device that is able to detect or measure the absolution position of the movable member 115 at the coupling region and that provides that position to the electronic control system 110 to provide feedback to the electronic control system 110 for operating the linear electrical actuator 130 and the linear hydraulic actuator 125. Thus, the position detector 145 can be a linear encoder using any suitable technology such as, for example, optical, capacitive, magnetostrictive, magnetoresistive, or inductive.

The linear hydraulic actuator 125 is arranged in the direction of the main axis 120 and includes a rod 150 that is the output of the linear hydraulic actuator 125 and that couples to (for example, attaches to) the movable member 115. The rod 150 is movable in both directions along the main axis 120. The linear hydraulic actuator 125 is hydraulically coupled to a hydraulic control member (for example, a valve) 155, the hydraulic control member is mechanically connected to a servo motor or to an electrical actuator 165 through a mechanical linkage system 170, and the electrical actuator 165 is connected to an electrical control device 172, which is connected to the electronic control system 110.

The electronic control system 110 includes a processor 175 that controls operation of the press machine 105 based on program data (including an application program and an operating system) stored in a fixed memory. The control system 110 also includes a temporary memory 180 that can be read and written at any time, one or more output devices 185 such as a display, and one or more input devices 190 such as a mouse and keyboard. The control system 110 is configured to operate such that the linear hydraulic actuator 125 is controlled in accordance with a cyclic operation of the hydraulic control member 155, and such that each linear electric actuator 130 is controlled dependent on position signals in order to ensure a controlled cyclic actuation of the movable member 115.

Referring also FIGS. 2-5, details of the press machine 105, including features not shown in FIG. 1, are shown. The movable member 115 is positioned between frame walls 200 that are mounted to immovable supports 205 such that the movable member 115 is able to move freely along the main axis 120 and within the cavity formed by the frame walls 200 and a top plate 202. The frame walls 200 and the immovable supports 205 can be made of any rigid material and any size to provide enough support to the internal components of the press machine 105 during operation. For example, the frame walls 200 and the supports 205 can be made of metal. The movable member 115 can be any guided structure or mass for exerting pressure or for pulling. The movable member 115 can be made of a rigid material that is suitable for such function, for example, metal.

The press machine 105 includes a base plate 210 that is attached to the frame walls 200 and is used to provide support for, among other features, the linear hydraulic actuator 125, the hydraulic control member 155, the mechanical linkage system 170, and the electrical actuator 165. The base plate 210 also includes an opening through which the rod 150 can freely and linearly move along the main axis 120.

The press machine 105 includes a bed 215 that is attached to the frame walls 200 and is used to support a bolster 220. The bolster 220 defines channels or openings 225 that receive the dies (not shown). Correspondingly, the movable member 115 includes a region 230 that defines channels 235 for receiving the punches (not shown). The bed 215 defines openings 240 sized to accommodate the posts 135, and each opening 240 is outfitted with roller bearings 245 to facilitate movement (for example, by reducing friction) of the posts 135 along the main axis 120.

Figure 3:
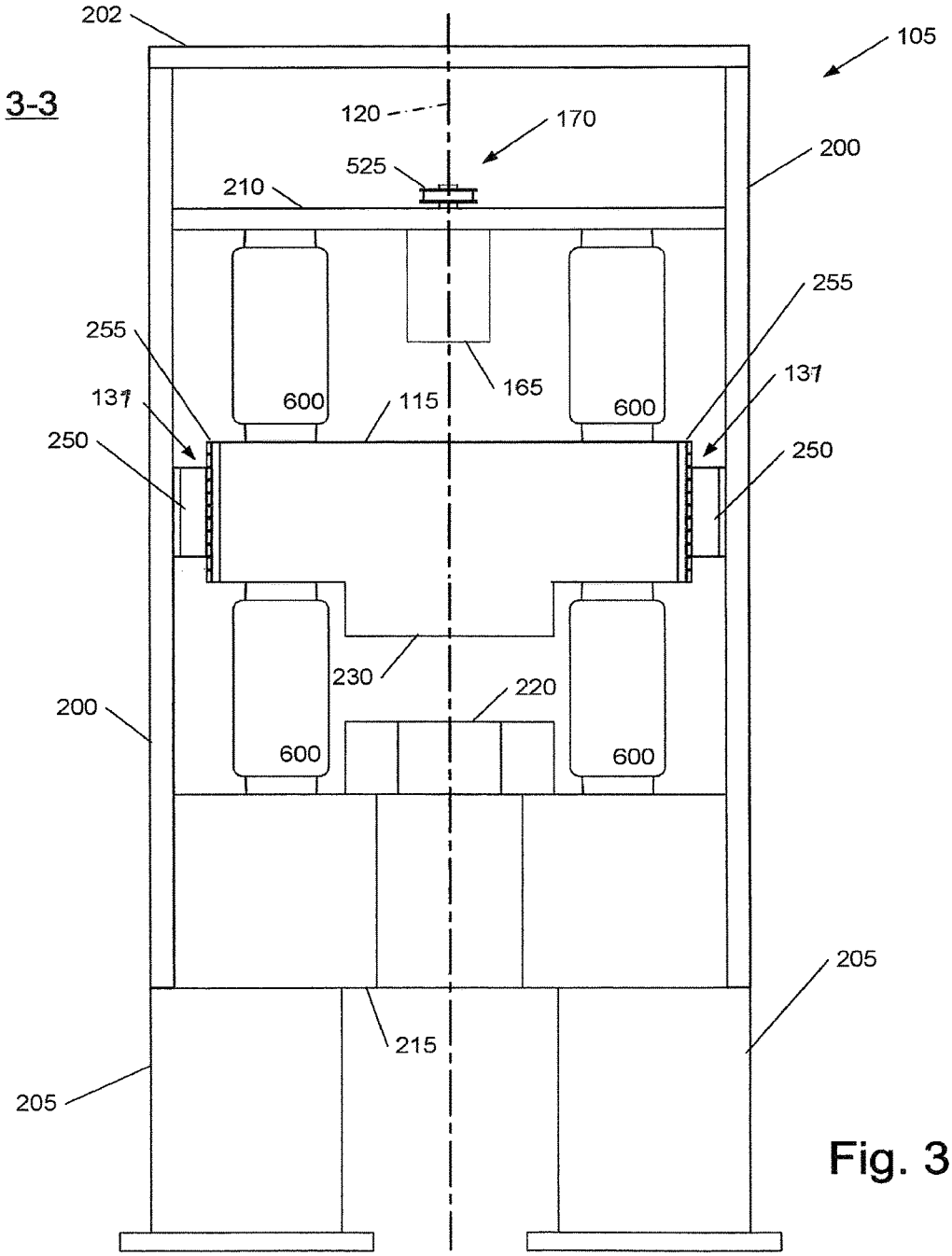
FIG. 3 shows a cross sectional view (along lines 3-3 in FIG. 2) of the drive mechanism according to the first implementation.
Figure 4:
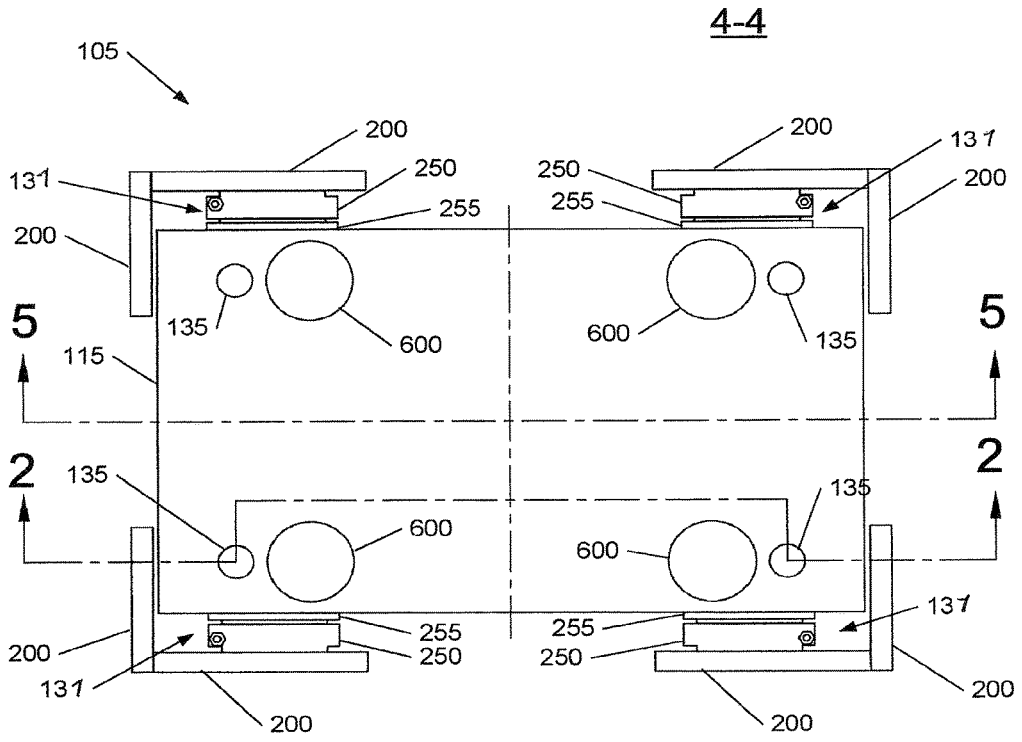
FIG. 4 shows a cross sectional view (along lines 4-4 in FIG. 2) of the drive mechanism according to the first implementation.
Figure 5:
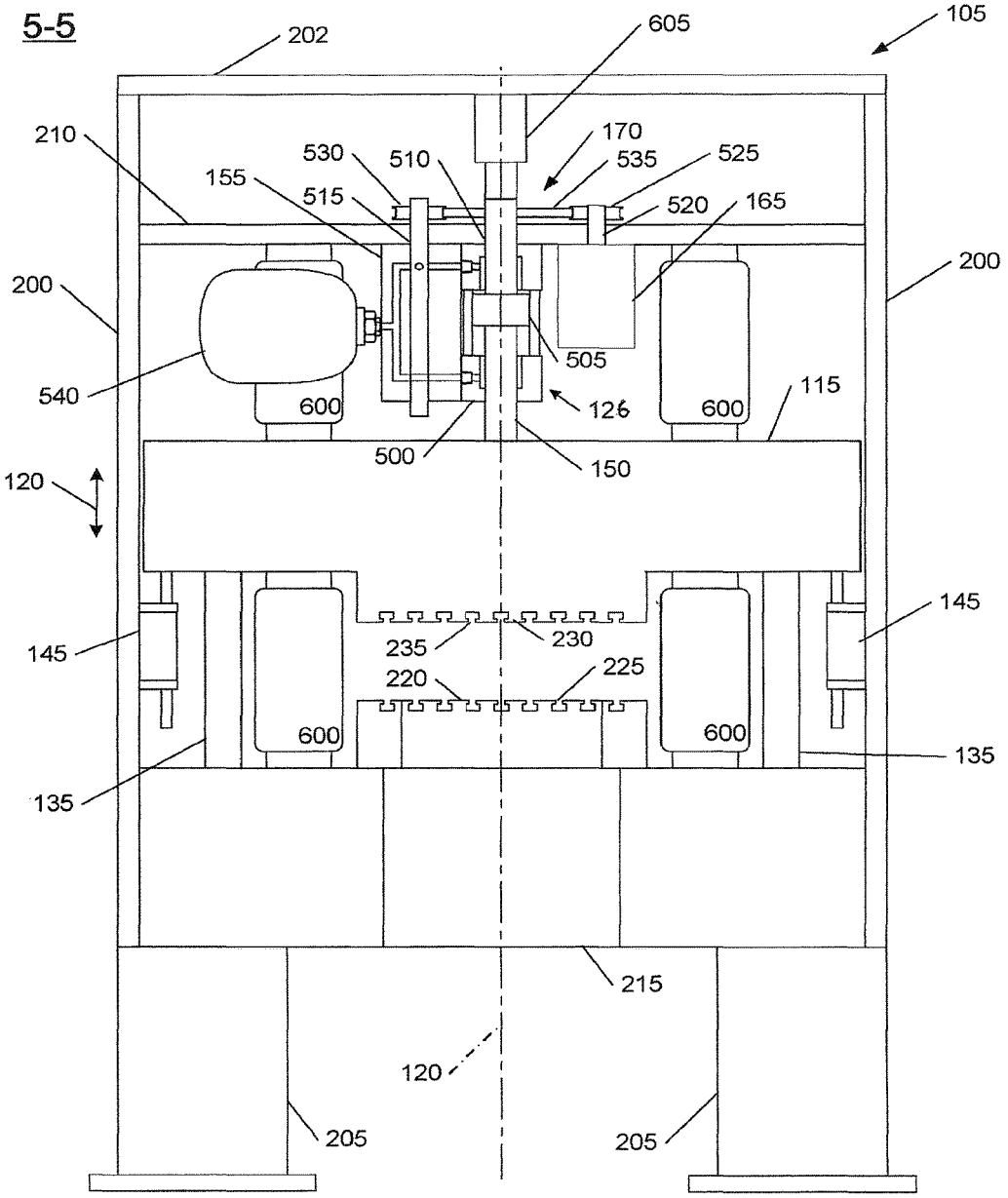
FIG. 5 shows a cross sectional view (along lines 5-5 in FIG. 4) of the drive mechanism according to the first implementation.

The linear electrical actuator 130 can be any linear actuator that produces a linear movement and whose primary motivating power is supplied by electricity. For example, in a most preferred embodiment, the linear electrical actuator 130 can be a direct drive linear motor 131 (FIGS. 3 and 4). In one implementation, the linear electrical actuator is a direct drive linear motor (model DDL ICII-250) produced by Kollmorgen (www.DanaherMotion.com). The linear electrical actuators 130 are independently operable through control of the electrical control device 140 by the electronic control system 110 within the range of motion provided in the press machine 105. With that, it is possible to provide an independent positional adjustment of the movable member 115 at the coupling point of the respective electrical actuators 130, in particular, to provide adjustment of one or more of a pitch, a roll, and a linear position of the movable member 115.

In this preferred implementation wherein the linear electrical actuators are direct drive motors, the direct drive linear motors 131 are positioned along a side of the movable member 115 and an inside of the frame walls 200. The direct drive linear motors 131 include coil slides (stators) 250 that are fixed to the frame walls 200 and magnet plates 255 that are fixed to the respective posts 135.

As discussed above, the position detector 145 measures an absolute position of the movable member 115 at the coupling region and provides that position to the electronic control system 110 to provide feedback to the electronic control system 110 for operating the linear electrical actuator 130 and the linear hydraulic actuator 125. The position detector 145 can be a linear encoder (for example, a sensor or a transducer) paired with a scale that encodes position. The sensor reads the scale in order to convert the encoded position into an analog or digital signal, which can then be decoded into a digital position. Motion can be determined by change in position over time.

Figure 7A:
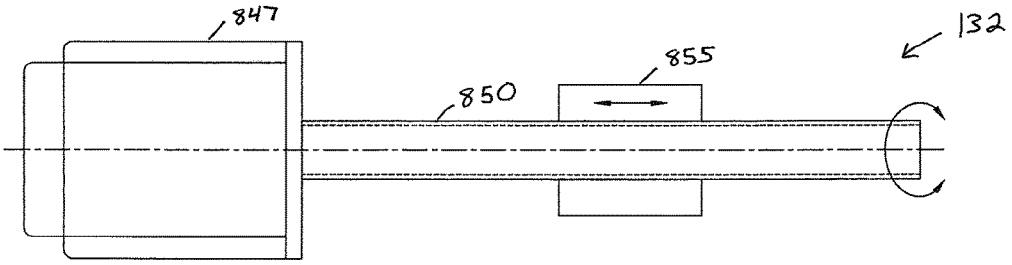
FIG. 7A shows a view of a lead screw and nut embodiment of the linear electrical actuator.
Figure 7B:
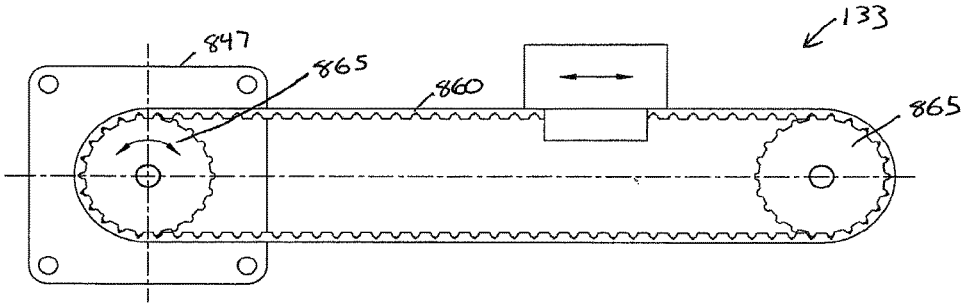
FIG. 7B shows a view of a timing belt and pulley embodiment of the linear electrical actuator.
Figure 7C:
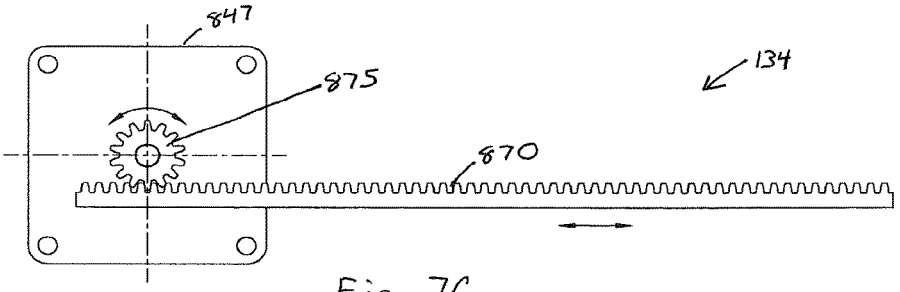
FIG. 7C shows a view of a rack and pinion gear embodiment of the linear electrical actuator.

In less preferred embodiments, the linear electrical actuator 130 is a rotary electric motor 847 and a mechanism for converting rotary motion to linear motion. Such mechanisms could include, but are not limited to, lead screw 850 and nut 855 mechanisms 132 (FIG. 7A), timing belt 860 and pulley 865 mechanisms 133 (FIG. 7B) and rack 870 and pinion gear 875 mechanisms 134 (FIG. 7C).

The linear hydraulic actuator 125 can be any linear actuator that produces a linear movement and whose primary motivating power is supplied by hydraulic fluid. For example, in a most preferred embodiment, linear hydraulic actuator 125 is a piston and cylinder mechanism 126 (FIGS. 2 and 5-6C) including a cylinder 500 that is mounted to the base plate 210 and that houses a hydraulic fluid such as an oil, and contains the rod 150, which connects at a lower end to the movable member 115. The other end of the rod 150 is connected to a piston 505, which is connected to an upper rod 510 that extends and moves freely through the base plate 210. In this way, the rod 150, the piston 505, and the rod upper 510 all move in a rigid manner in response at least to control by the hydraulic control member 155.

Figure 8A:
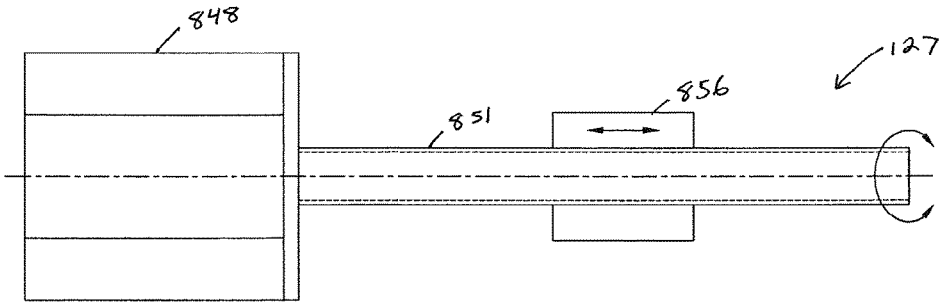
FIG. 8A shows a view of a lead screw and nut embodiment of the linear hydraulic actuator.
Figure 8B:
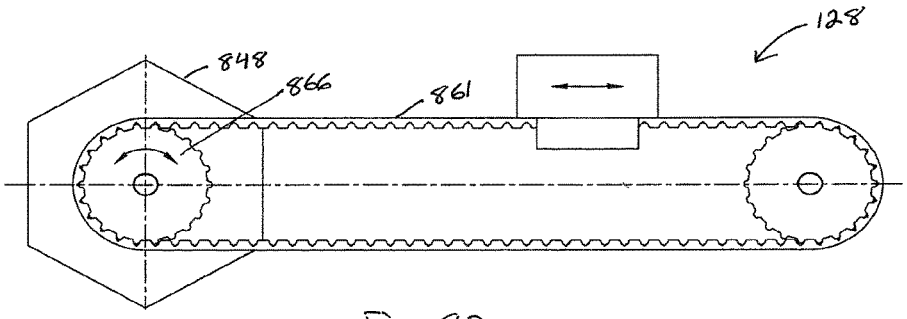
FIG. 8B shows a view of a timing belt and pulley embodiment of the linear hydraulic actuator.
Figure 8C:
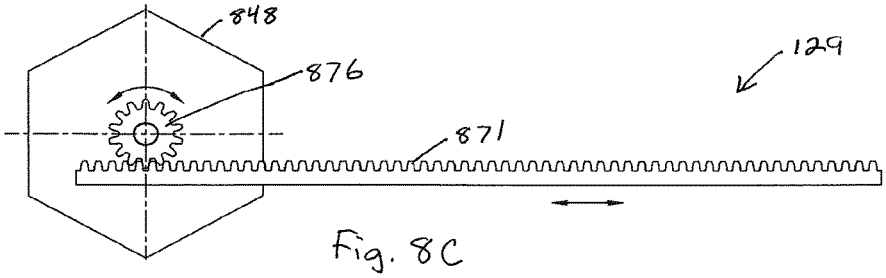
FIG. 8C shows a view of a rack and pinion gear embodiment of the linear hydraulic actuator.

In a less preferred embodiment, the linear hydraulic actuator 125 is a rotary hydraulic motor 848 and a mechanism for converting rotary motion to linear motion. Such mechanisms can include, but are not limited to, lead screw 851 and nut 856 mechanisms 127 (FIG. 8A), timing belt 861 and pulley 866 mechanisms 128 (FIG. 8B) and rack 871 and pinion gear 876 mechanisms 129 (FIG. 8C).

The hydraulic control member 155 includes a rotatable member or shaft 515 that extends through the base plate 210 and is coupled to one end of the mechanical linkage system 170 and the electrical actuator 165 includes a shaft 520 that extends through the base plate 210 and that is coupled to another end of the mechanical linkage system 170 such that rotation of the shaft 520 causes rotation of the shaft 515. The mechanical linkage system 170 includes a wheel (or gear) 525 rigidly attached to the shaft 520, a wheel (or gear) 530 rigidly attached to the shaft 515, and a pulley or chain 535 that couples at one region to the wheel 525 and at another region to the wheel 530 to transmit rotational energy from the shaft 520 to the shaft 515.

The hydraulic control member 155 is fluidly connected to an accumulator 540 (a high-pressure storage tank) for receiving high pressure hydraulic fluid and to an unpressurized tank 545 (shown in FIG. 1) that can be external to the press machine 105 and is configured to receive outflow from the member 155 during operation, as further discussed below.

The drive apparatus 100 also includes devices within the enclosure of the press machine 105 that need not be directly coupled to the electronic control system 110. In particular, the drive apparatus 100 includes one or more energy storage devices 600 that are coupled to coupling points or regions of the movable member 115, and at least one passive force exerting device 605 (which also acts as an energy storage device) that is coupled to a coupling region of the movable member 115.

The one or more energy storage devices 600 are any devices that can store energy supplied by the movement of the movable member 115 (due to the actuation of the linear hydraulic actuators 125 and the linear electrical actuators 130) such that the stored energy can be supplied to and used by the movable member 115 to adjust the motion of the movable member 115. The energy storage device 600 is a linear energy storage device fluidly decoupled from the linear hydraulic actuators 125. For example, the energy storage devices 600 can be gas springs that supply forces along the main axis 120. The energy storage device 600 can have an adjustable force path characteristic that imparts energy to the movable member 115 among the main axis 120. The force path characteristic is the relationship between a differential force needed to achieve a differential change of position at the coupling point. The force path characteristic of the energy storage device 600 is preferably such that the force exerted by the energy storage device 600 on the movable member 115 changes its direction at a position of the movable member 115 that is within the working range of the movable member 115 or provides a positioning of the movable member within an operational range of the movable member 115.

As shown in FIGS. 2-5, four energy storage devices 600 are positioned above the movable member 115 and four energy storage devices are positioned below the movable member 115. The energy storage devices 600 above the movable member 115 release energy to the movable member 115 in a first linear direction along the main axis 120, where the first linear direction corresponds to the direction in which the movable member 115 is moving toward the bed 215. The energy storage devices 600 below the movable member 115 release energy to the movable member 115 in a second linear direction that is opposite to (and parallel with) the first linear direction along the main axis 120, where the second linear direction corresponds to the direction in which the movable member 115 is moving away from the bed 215.

The energy storage devices 600 provide a positioning of the movable member 115 within an operational range of the movable member 115. If the energy storage devices 600 are gas springs, then the force path characteristic of the gas springs can be adjusted by changing the gas pressure within the gas springs, in particular by increasing the gas pressure utilizing a pressure gas source or by decreasing the gas pressure utilizing an outlet valve. Alternatively, the energy storage devices 600 can be elastic springs and the force path characteristic of the spring can be adjusted by adjusting a position of an end of the spring that is opposed to the end at the coupling point, such as to increase or decrease the spring force on the movable member 115.

The force path characteristics of the energy storage devices 600 can be adjusted by the control system 110 using input from a user. Moreover or alternatively, the force path characteristic of the energy storage devices 600 can be adjusted such that the natural frequency of the drive apparatus is at or close to the movement frequency of the movable member. Thus, the energy storage devices 600 are particularly useful when operating the drive apparatus 100 in a periodic, harmonic fashion (for example, sinusoidal and having a natural frequency). The control system 110 can adjust the natural frequency of the drive apparatus 100 by adjusting the force path characteristics of the energy storage devices 600 in dependence on a set operation frequency of the drive apparatus 100 such that the natural frequency is close to or identical with the operation frequency of the drive apparatus 100. With that, the energy consumption of the actuators can be significantly reduced. The control unit 110 is preferably configured to automatically adjust the force path characteristic of the at least one energy storage device such that the drive apparatus 100 operates at or close to the natural frequency of the drive apparatus 100. The preferred force path characteristic is characterized by the proportional relationship $F=k*x$, where F is force, k is a constant and x is the displacement of the energy storage device. The control unit 110 determines the required force path characteristic or the required spring constant of the at least one gas or elastic springs 600 for operating at or close to the natural frequency of the drive apparatus 100: by calculating the necessary force path characteristic or the necessary spring constant on basis of the moving masses and the desired operating frequency; by using selected or predetermined values; or by adjusting the force path characteristic in dependence on the power consumption of the at least one actuator. The latter possibility is the most preferred embodiment because a reduction of the power consumption is one goal of providing the energy storage device 600 and of the adjustment of its force path characteristic. In case of the first possibility, the relationship $\omega=\sqrt{(k/m)}$ can be used to calculate the required force path characteristic of the energy storage device where $\omega$ is the natural frequency, m is the sum of the moved masses and k is the proportional spring constant of the force path characteristic, of the drive apparatus 100 or the energy storage device 600, respectively.

The passive force exerting device 605 can be designed as a pressurized cylinder of fluid that provides a force to the rod 510 of the linear hydraulic actuator 125. For example, the device 605 can be a cylinder filled with a gas such as nitrogen gas. Preferably, the passive force exerting device 605 has a force path characteristic that does not or only insignificantly changes the force dependent on the position of the rod 510. This can be achieved by a comparatively large working volume of the cylinder, or by connecting the cylinder to an additional reservoir.

The passive force exerting device 605 applies a force along the first linear direction to the movable member 115 through the rod 510 of the linear hydraulic actuator 125 primarily in a first direction. The passive force exerting device 605 does not require an external energy supply to provide the force. The passive force exerting device 605 primarily receives and stores energy while the movable member 115 is moving in a second direction. Moreover, the force applied to the movable member 115 by the passive force exerting device 605 is a force that adds to or subtracts from the force applied by the linear hydraulic actuator 125 and/or the linear electrical actuators 130. The passive force exerting device 605 is compressed by the actuation of the hydraulic actuator(s) 125 and/or the electric actuator(s) 130. Therefore, the actuation of these actuators in the second direction can be used in order to store energy in the passive force exerting device 605 so that the lifting actuation of the actuators can also be used in order to finally increase the pressing/punching force.

In this way, the passive force exerting device 605, the energy storage device 600, the linear hydraulic actuator 125, and the linear electrical actuators 130 are all arranged in parallel with the main axis 120 of the movable member 115. Thus, each of these devices applies a force that is generally parallel with the main axis 120. The passive force 605 exerting device is fluidly decoupled from the hydraulic actuator 125.

Referring also to FIGS. 6A-6D, additional features of the linear hydraulic actuator 125 and the hydraulic control member 155 are shown. The hydraulic control member 155 includes a stationary block 800 that is mounted to the base plate 210 and the shaft 515 that is able to rotate within the block 800 upon actuation by the electrical actuator 165 (see FIG. 2). The shaft 515 defines two internal fluid flow paths 805, 810, both having three inlet/outlet openings, and the space between the shaft 515 and the stationary block 800 is fluidly sealed by a sealing system 815. The sealing system 815 can be, for example, an O-ring that fits within an O-ring groove formed at an interface between an internal surface of the block 800 and an external surface of the shaft 515. The shaft 515 is configured to rotate about a valve axis 820 that, in this implementation, is parallel with the main axis 120. The block 800 includes two internal fluid flow paths 825, 830, an inlet port 835 that fluidly couples to the accumulator 540 with pressurized fluid, and two outflow ports 840, 845 that fluidly couple to the unpressurized tank 545.

Figure 6A:
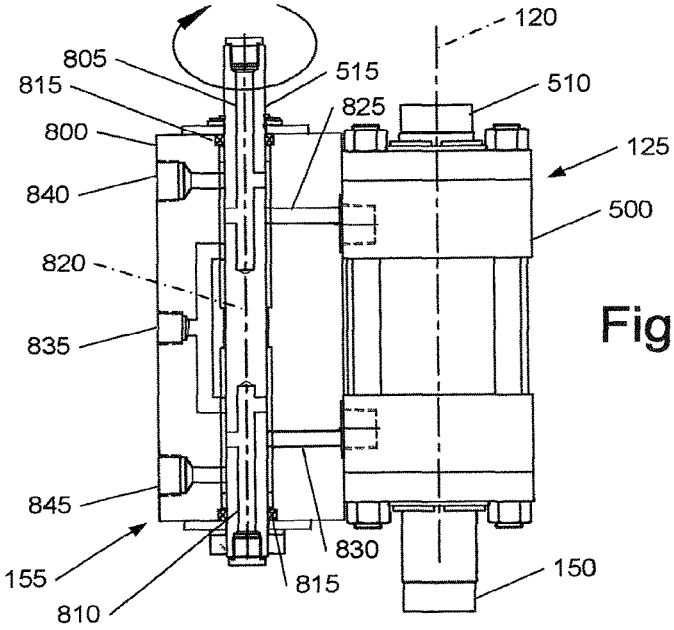
FIGS. 6A-6D show cross sectional views of an implementation of a hydraulic control member that can be used in the drive mechanism of FIGS. 1-5.
Figure 6B:
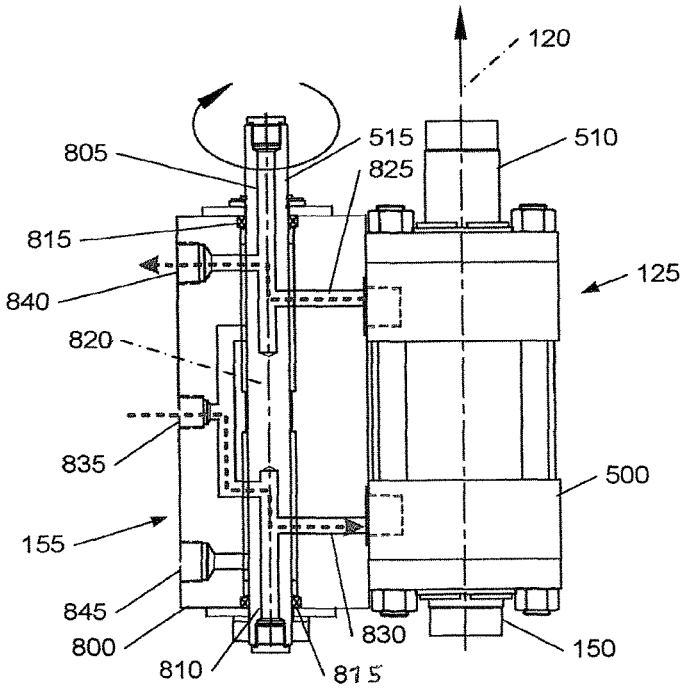
Figure 6C:
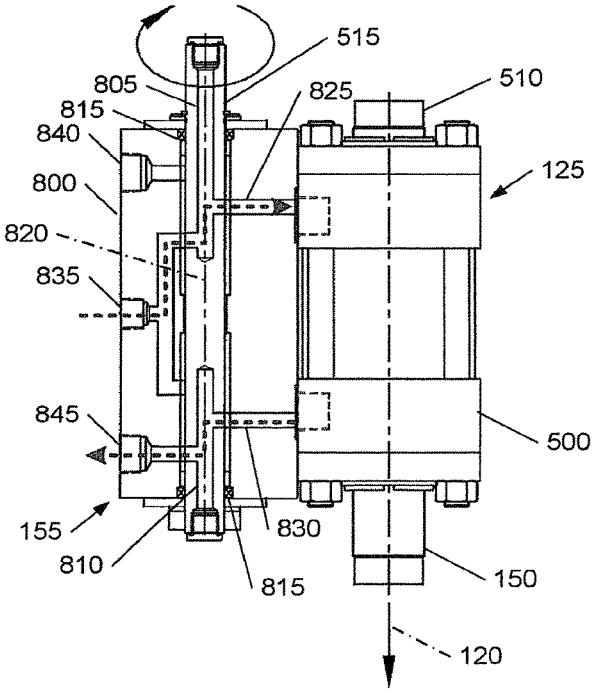
Figure 6D:
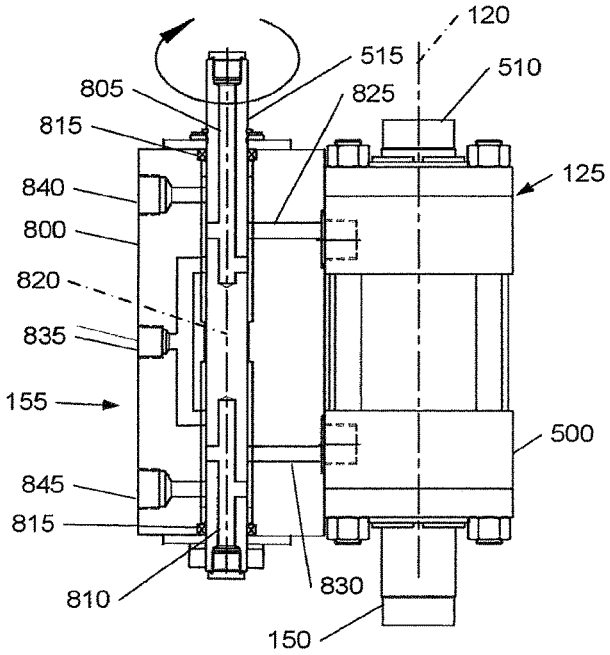

FIGS. 6A-6D show four positions of shaft 515. In the ("third") position shown in FIGS. 6A and 6D, there is no fluid connection between inlet/outlet ports 835, 840, 845 and the upper and lower chambers of the cylinder 500. Therefore, a movement of rod 150 is blocked in these positions. In the ("second") position of shaft 515 as shown in FIG. 6B, the inlet port 835 is in fluid connection with the lower chamber of cylinder 500, and the upper chamber of cylinder 500 is in fluid connection with outlet port 840 so that rod 150 is moved in upward direction. Accordingly, in the ("first") position of shaft 515 in FIG. 6C, the inlet port 835 is in fluid connection with the upper chamber of the cylinder 500, and the lower chamber of the cylinder 500 is in fluid connection with the outlet port 845 so that the rod 150 is moved in downward direction.

In a preferred embodiment, an actuation cycle of the drive apparatus 100 includes the steps of: (a) driving the at least one hydraulic actuator 125 and the at least one electric actuator 130 in the first direction, (b) driving the at least one hydraulic actuator 125 and the at least one electric actuator 130 in the second direction, and (c) holding the movable member 115 in a fixed position by positioning the hydraulic control member 155 in the third position, where the at least one electric actuator 130 is, at least during part of this operation step, not operated or not provided or only insignificantly provided with electric current. An advantage of this operation is that the at least one electric actuator 130 has a time interval during a cycle in which the electric actuator(s) 130 can cool down. The blocked hydraulic control member 155 blocks in its third position any movement of the hydraulic actuator 125 and thus the movable member 115 so that also the passive force exerting device 605, if present, can be held in a compressed state without the need of the additional force of the at least one electric actuator 130 (although this additional force can be used to compress the passive force exerting device 605).

The rotation of shaft 515 can be controlled utilizing the electric actuator 165 (which is controlled by the electrical control device 172 and the electronic control system 110) as required by the specific application. The rotation of shaft 515 may operated with a constant frequency and/or a constant speed. The rotation of shaft 515 can be operated at rotational speeds that are dependent on the angle positions of the shaft 515 in order to control the timing of the positions of the shaft 515. In case of a rotation with constant speed, the rod 150 moves up and down close to a sinusoidal function. In addition, the position of the shaft 515 can be controlled by varying the rotational speed dependent on the angle position of the shaft or dependent on the time, respectively. During one cycle, the shaft 515 can also be stopped one or more times, for example, if the rod 150 should be blocked for a comparatively long time period during the cycle in its upper position. Further, if only a very quick downward and subsequent upward movement is required, the rotational speed between the positions shown in FIG. 6C (lowering) and FIG. 6B (lifting) can be increased (compared to the average rotational speed) in order to have no or only an insignificant time period of blockage of the rod 150 between these positions.

Due to the hydraulic control member 155, the hydraulic actuator 125 can be moved precisely with high speeds, where the hydraulic actuator 125 can provide high pressing/punching forces at the same time. As a result, the control of the force and path characteristics of the hydraulic actuator 125 is improved so that the interaction with the other components of the drive apparatus 100 (for as far as given) is also improved. As a result, a press machine 105 can be operated in a highly variable manner dependent on the requirements of the application.

As already described, the drive apparatus 100 can be operated in various operation modes. In a first mode, only the electric actuators 130 can be used in combination with the energy storage devices 600 (with preferably adjustable force path characteristic). In order to reduce power consumption, the electrical actuators 130 can move the movable member 115, for example, in a sinusoidal manner (regarding path over time graph), where the force path characteristic of the energy storage devices 600 is adjusted to this sinusoidal movement such that the time period of the natural frequency corresponds to the time period of the sinusoidal movement of the electric actuators.

In a second mode, the hydraulic actuator 125, and, if desired, the at least one electric actuator 130, can be used in combination with the passive force exerting device 605. This mode is advantageous in case of higher necessary punching or pressing forces. In this mode, power consumption is reduced by keeping the lifting actuation to a minimum so that the fluid supplied to the hydraulic actuator 125 can be reduced accordingly. As already mentioned, the lifting movement of the hydraulic actuator 125 can be used in order to compress the passive force exerting device 605 for storing additional energy. This mode is preferred in case of high necessary forces and in case of non-sinusoidal movements of the movable member 115. In the latter case, the graph regarding path over time could, for example, be a horizontal line interrupted by short downwardly directed peaks. Or, according to another example, the graph regarding path over time could be a "partial" sinusoidal graph with only the downwardly directed sinus curves, where the upwardly directed sinus curves are substituted by horizontal lines. As an unnecessary high lifting movement is avoided, also the speed of the drive apparatus 100 can be increased.

Also mixed (third) modes are possible in which the electric and hydraulic actuators are used in combination with the energy storage devices 600 and the passive force exerting device 605, where the spring constant of the energy storage device(s) and the characteristic of the passive force exerting devices can be optimized in order to reduce power consumption (for example, by means of a least squares method).

As a result, the drive apparatus 100 as described above can be used in various manners, depending on the needs of a particular application. The user can use the drive apparatus 100, for example, for a press, in the first mode if a high speed operation with low forces is required, or in the second mode, if higher forces with lower speeds are required.

Without further analysis, the foregoing will so fully reveal the gist of the embodiments of the present invention that others can, by applying current knowledge, readily adapt it for various applications without omitting features that, from the standpoint of prior art, fairly constitute characteristics of the generic or specific aspects of the embodiments of the present invention.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. A press comprising:

a movable member; and drive apparatus for the movable member, the drive apparatus comprising at least one actuator coupled to the movable member for moving the movable member in reversible directions, and at least one energy storage device coupled to the movable member, wherein the at least one energy storage device has a force path characteristic, wherein the force path characteristic of the at least one energy storage device is such that the force exerted by the at least one energy storage device on the movable member changes its direction at a position of the movable member which is within the working range of the movable member, wherein the force path characteristic of the at least one energy storage device is adjustable such that the natural frequency of the drive apparatus is at or close to the movement frequency of the movable member, and wherein the at least one energy storage device comprises:

at least one gas spring positioned relative to the movable member and the at least one actuator to store energy that can be released along a first direction along the linear axis of the at least one gas spring, and at least one gas spring positioned relative to the movable member and the at least one actuator to store energy that can be released along a second direction along the linear axis at least one gas spring, where the second direction is opposite to the first direction.

2. The press of claim 1, wherein the force path characteristic of the at least one energy storage device is such that the force exerted by the at least one energy storage device on the movable member provides a positioning of the movable member within an operational range of the movable member.

3. The press of claim 1, wherein the force path characteristic of the at least one gas spring is adjustable by adjusting a gas pressure within the at least one gas spring, by increasing the gas pressure utilizing a pressure gas source or by decreasing the gas pressure utilizing an outlet valve.

4. The press of one of claim 1, further comprising a control unit, wherein the control unit is configured to adjust the force path characteristic of the at least one energy storage device such that the natural frequency of the drive apparatus is at or close to the movement frequency of the movable member.

5. The press of claim 4, wherein the control unit determines a required force path characteristic of the at least one energy storage device for operating at or close to the natural frequency of the drive apparatus by calculating the required force path characteristic on basis of a mass of the moveable member and a desired operating frequency.

6. The press of claim 4, wherein the control unit determines a required force path characteristic of the at least one energy storage device for operating at or close to the natural frequency of the drive apparatus by using selected or predetermined values.

7. The press of claim 4, wherein the control unit determines a required force path characteristic of the at least one energy storage device for operating at or close to the natural frequency of the drive apparatus by adjusting the force path characteristic in dependence on the power consumption of the at least one actuator.

* * * * *